US006361378B1

(12) United States Patent
Konoya et al.

(10) Patent No.: US 6,361,378 B1
(45) Date of Patent: Mar. 26, 2002

(54) CONNECTOR WITH A SIDE RETAINER

(75) Inventors: Hisashi Konoya; Hideto Nakamura, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/455,798

(22) Filed: Dec. 7, 1999

(30) Foreign Application Priority Data

Jan. 11, 1999 (JP) ..... 11-003802

(51) Int. Cl.[7] ..... H01R 13/514; H01R 13/40
(52) U.S. Cl. ..... 439/752; 439/595
(58) Field of Search ..... 439/752, 595, 439/489

(56) References Cited

U.S. PATENT DOCUMENTS

| | | | | |
|---|---|---|---|---|
| 5,782,657 A | | 7/1998 | Wolla et al. | |
| 5,928,038 A | * | 7/1999 | Berg et al. | 439/752 |
| 6,004,164 A | * | 12/1999 | Seko et al. | 439/752 |
| 6,083,058 A | * | 7/2000 | Fujiwara | 439/752 |

FOREIGN PATENT DOCUMENTS

| | | |
|---|---|---|
| DE | 44 39 386 | 5/1996 |
| DE | 196 39 705 | 4/1998 |
| EP | 711 005 | 5/1996 |
| EP | 881 112 | 12/1998 |
| JP | 61-162970 | 10/1986 |
| JP | 1174988 | 7/1989 |
| JP | 3172777 | 7/1991 |
| JP | 4368416 | 12/1992 |
| JP | 5264642 | 10/1993 |
| JP | 9184866 | 7/1997 |
| JP | 10160778 | 6/1998 |
| JP | 10253693 | 9/1998 |

* cited by examiner

*Primary Examiner*—Brian Sircus
*Assistant Examiner*—Chandrika Prasad
(74) *Attorney, Agent, or Firm*—Banner & Witcoff, Ltd.

(57) ABSTRACT

The invention provides a connector with a housing having a simple configuration. After an L-shaped side retainer 30 has been fitted in a temporary stopping position within an opening groove 22 of an inner housing 20, this inner housing 20 is inserted from an anterior direction into a fitting channel 12 of an outer housing 10. A locking protrusion 13 provided in the fitting channel 12 engages a locking member 26 of the inner housing 20, and the inner housing 20 is thereby attached. When the side retainer 30 is to be moved from the temporary stopping position to a main stopping position in which male terminal fittings 1 can be retained, a jig or the like is inserted into the fitting channel 12 to move an operating member 35 formed on an anterior edge of the side retainer 30.

20 Claims, 9 Drawing Sheets

CONNECTOR WITH A SIDE RETAINER

TECHNICAL FIELD

The present invention relates to a connector provided with a side retainer.

BACKGROUND TO THE INVENTION

One type of electrical connector is provided with a side retainer, in which a retainer is inserted into a housing from a side face thereof and retains terminal fittings. In this type of connector the terminal fittings are retained directly, and it therefore has the advantage of having a strong stopping force. However, side retainers must have an opening into the side face of the housing to allow the insertion of the retainer. This makes this type unsuitable for water-proofing, and it has accordingly been difficult to make side retainers water-proof.

A connector has been proposed in JP-61-162970 to solve this problem. This has a configuration whereby a separate rubber gasket is attached to an insertion hole of the side retainer, providing the insertion hole with a seal.

However, in the connector described above, a specialised rubber gasket is necessary and, consequently. there is the problem that both the number of components and costs increase. Moreover the rubber gasket must be attached to a small component and, as a result, there is also the drawback that the attachment operation is troublesome. Furthermore, even in a connector which does not need to be water-proof, the side retainer protrudes outwards from the opening formed in the side face of the housing. As a result, there is the problem that foreign objects from the exterior might strike against the protruding portion, or that foreign objects might enter between the side retainer and the housing, etc., and therefore it is desirable that nothing protrudes from the opening.

The present invention has been developed after taking the above problem into consideration, and aims to present a connector in which a side retainer does not protrude to the exterior of the housing.

SUMMARY OF THE INVENTION

According to the invention, there is provided an electrical connector comprising an outer housing, an inner housing insertable in the outer housing, said inner housing being adapted to receive an electrical terminal therein, and a retainer insertable in the inner housing, said retainer being movable between a temporary condition in which a terminal is insertable, and a final condition in which said terminal is immovable, the retainer being movable between said temporary and final conditions after insertion of said inner housing in said outer housing. Such a retainer has the advantage that it is wholly within the outer housing, and thus does not require an exterior seal. Furthermore, it does not protrude, and is therefore not susceptible to contact damage.

The connector includes an attachment face for receiving a mating connector, and preferably the inner housing is inserted from this attachment face. In this way the outer housing can be miniaturised since an additional rear opening is not required. The wire protruding from the rear can be sealed against moisture in a conventional manner.

The outer housing may define a channel having a continuous wall, the inner housing being received within the channel. Locking means may be provided to retain the inner and outer housings together.

BRIEF DESCRIPTION OF THE DRAWINGS

Other features of the invention will be apparent from the following description of a preferred embodiment shown by way of example only in the accompanying drawings in which.

DESCRIPTION OF PREFERRED EMBODIMENT

Figure 1:
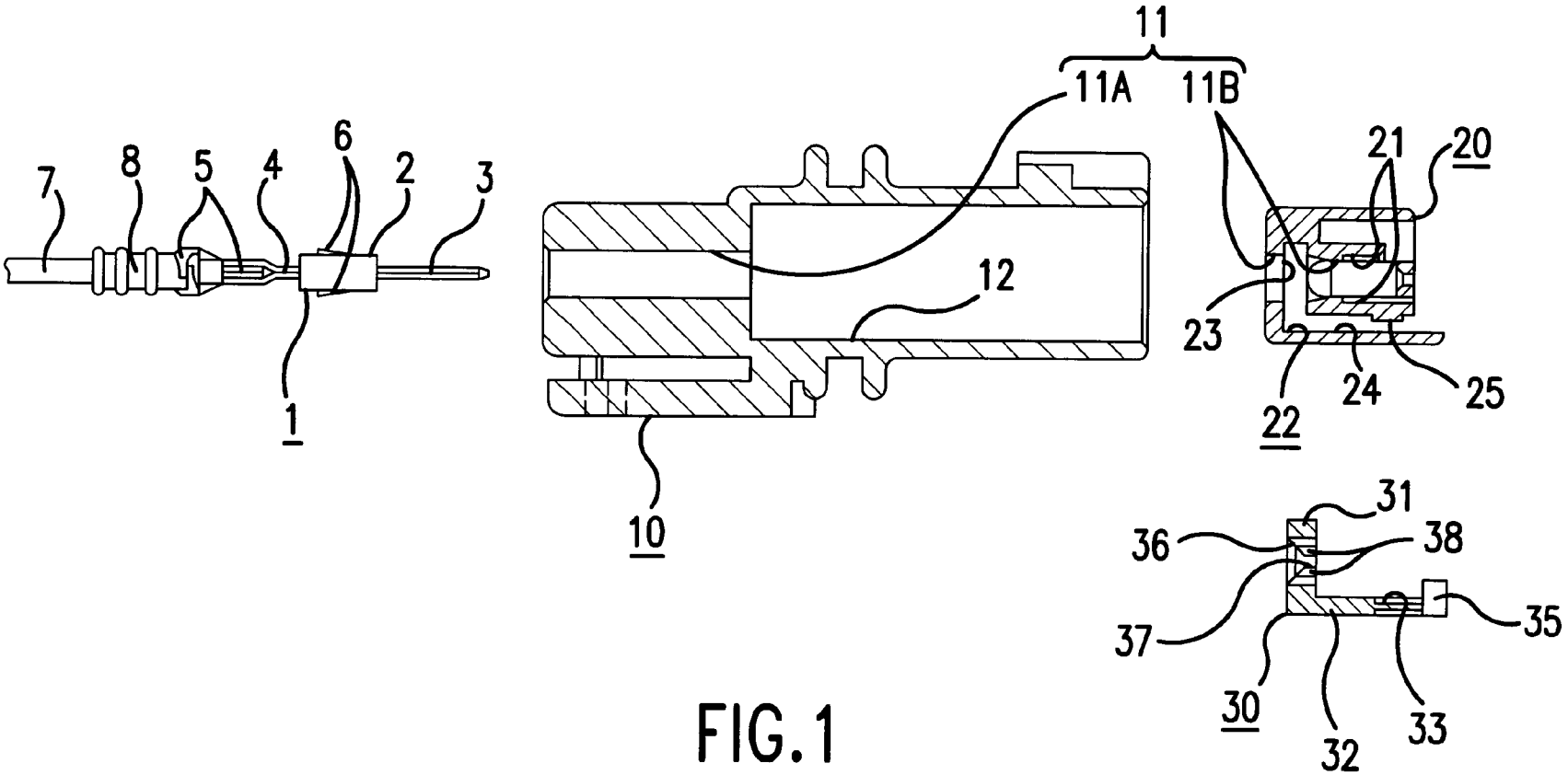
FIG. 1 is a disassembled side cross-sectional view of a connector of an embodiment of the present invention.
Figure 2:
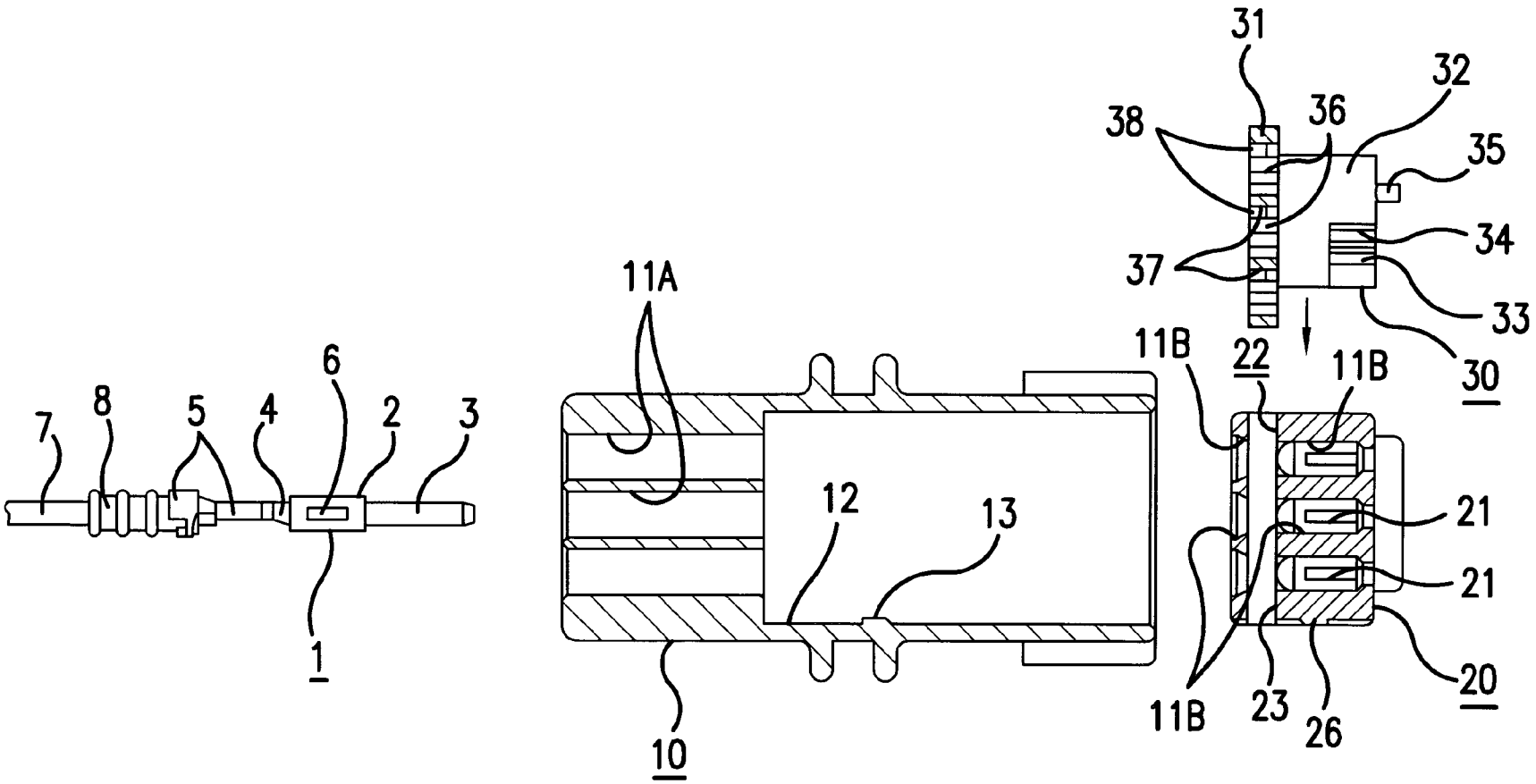
FIG. 2 is a disassembled plan view of the connector.

An embodiment of the present invention is described below with the aid of FIGS. 1 to 9. In this embodiment, a male water-proof connector is shown. As shown in FIGS. 1 and 2, this connector comprises an outer housing 10, an inner housing 20 attached to this outer housing 10, a side retainer 30 capable of being attached to the inner housing 20, and male terminal fittings 1 being housing within cavities 11 which extend from the housing 10 to a housing 20 (see FIG. 4).

Each male terminal fitting 1 comprises a box shaped main body 2, and a tab or pin 3 protruding from an anterior tip thereof, the tab being capable of joining with a corresponding female terminal fitting. A joining member 4 protrudes from a posterior tip of the main body 2, and a barrel member 5 is formed on the posterior of this joining member 4, an end portion of an electric wire 7 being attached thereto by crimping. Cantilevered lances 6 at upper and lower wall sides of the main body 2 protrude outwards, the base ends of these being at the anterior, and a water-proof rubber stopper 8 is attached to an anterior end portion of the electric wire 7.

The outer housing 10 forms an approximately cylindrical shape, openings being formed in the two end portions thereof. The cavity 11 for housing the male terminal fitting 1 is formed in one of these ends. As illustrated in the drawings, three horizontally aligned outer cavities 11A are formed in a posterior half of this cavity 11, these housing the barrel members 5 of the male terminal fittings 1 which are inserted into the outer cavities 11A from posterior openings thereof. The water-proof rubber stoppers 8 attached to the electric wires 7 can be pushed into the outer cavities 11A, thereby making them water-proof. The other end of the outer housing 10 has a fitting channel 12 into which fits a corresponding female connector (not shown). An inner housing 20 (explained in more detail below) is also housed within this fitting channel 12.

The inner housing 20 is formed in as a block, a cavity 11B constituting the anterior half of the cavity 11 being formed in the interior thereof. As illustrated in the drawings, the cavity 11B forms three horizontally aligned inner cavities 11 B capable of housing the main bodies 2 of the male terminal fittings 1. When the inner housing 20 is in an attached state within the fitting channel 12, these inner cavities 11B join with the outer cavities 11A to form the cavity 11. An upper face and lower face of each inner cavity 11B is provided with a stopping groove 21 which is open towards the anterior and engages the lances 6 of the male terminal fittings 1, thereby retaining them in the housing.

An opening groove 22 is provided in the inner housing 20, this opening groove 22 being formed along a side face on an innermost side of the inner housing 20 and an anterior face thereof; it forms an L-shape when in an open state. The opening groove 22 comprises a vertical groove member 23 and a horizontal groove member 24. The vertical groove member 23 opens into the side face of the innermost side and intersects with each of the inner cavities 11B, thereby dividing these inner cavities 11B into anterior and posterior portions. The horizontal groove member 24 opens into the side face of the innermost side and the anterior face and is formed below the inner cavities 11B (in the orientation as viewed in the drawings). The side retainer 30 can be inserted into this opening groove 22 from an opening portion in a side face of the inner housing 20. A stopping protrusion 25 formed on an upper face of the horizontal groove member 24 fits into a temporary stopping groove 33 or a main stopping groove 34 provided on the side retainer 30, thereby maintaining the side retainer 30 within the opening groove 22.

Figure 3:
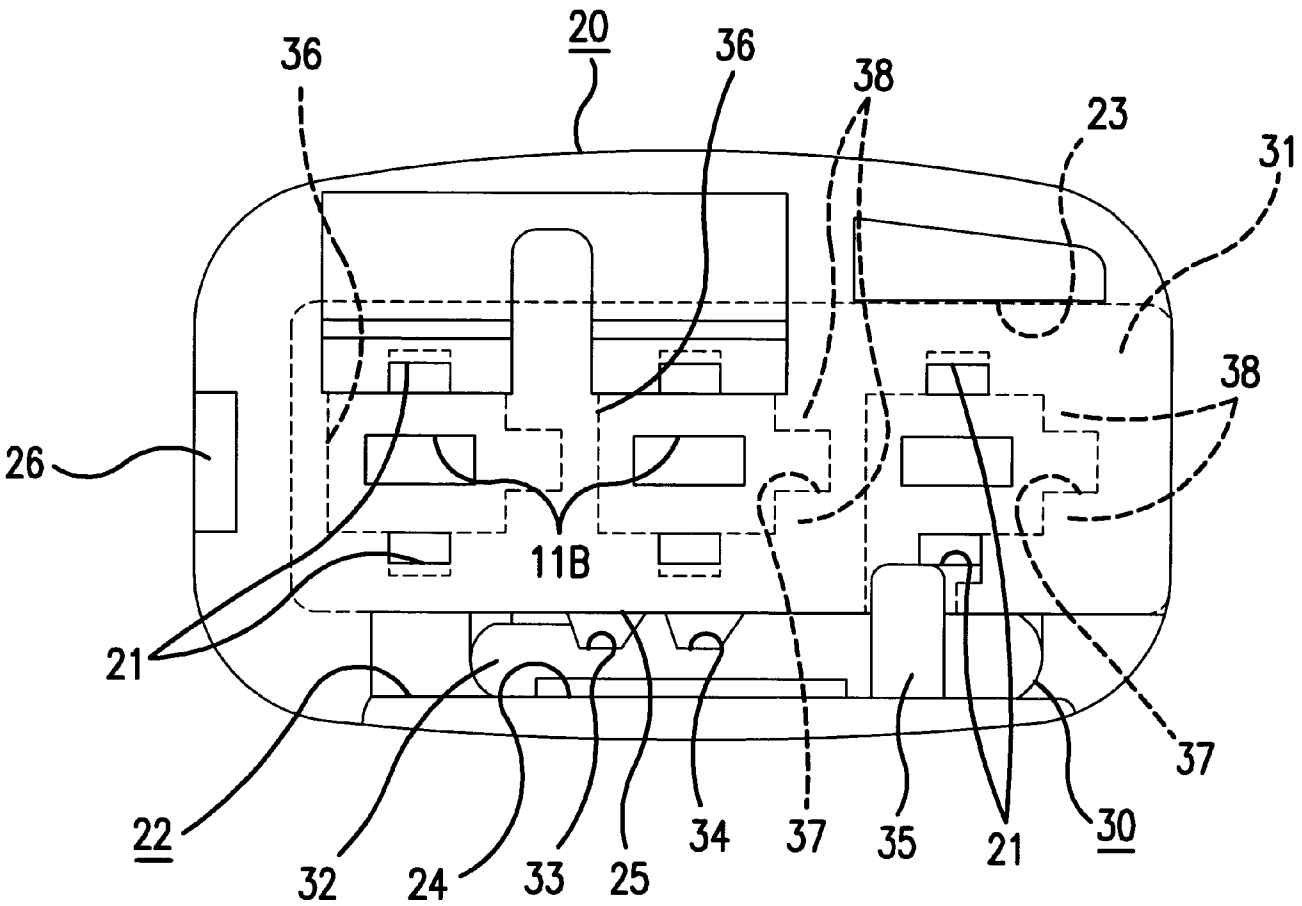
FIG. 3 is a front face view of an inner housing to which a side retainer is attached.

The side retainer 30 which forms an L-shape in its entirety, comprises a vertical plate member 31 (housed within the vertical groove member 23 of the opening groove 22 of the inner housing 20) and a horizontal plate member 32 (housed within the horizontal groove member 24). An anterior end of an upper face of the horizontal plate member 32 is provided with the temporary stopping groove 33 and the main stopping groove 34, these being located in sequence from the anterior relative to the direction of insertion. As shown in FIG. 3, the stopping protrusion 25 fits into the temporary stopping groove or the main stopping groove 34, thereby maintaining the side retainer 30 within the inner housing 20 in either a temporary stopping position or a main stopping in position, in positions differing from one another along a horizontal direction (in the orientation as viewed in the drawings). An operating member 35 which allows the side retainer 30 to be moved in a horizontal direction protrudes in an anterior direction from an anterior edge of the horizontal plate member 32.

Figure 4:
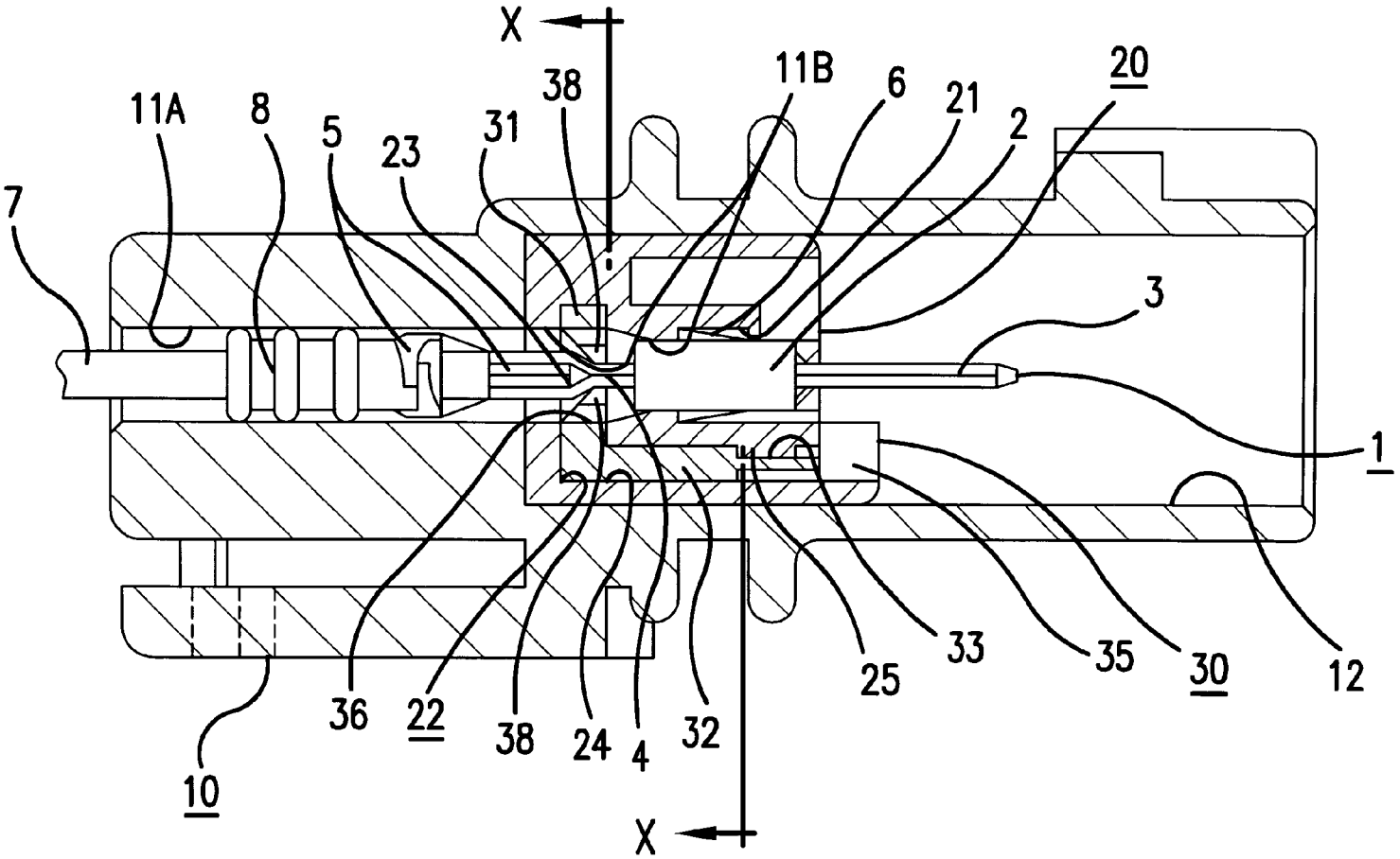
FIG. 4 is a side cross-sectional view of the connector provided with the side retainer in a temporary stopping position.

The vertical plate member 31 is provided with insertion holes 36 which, when the side retainer 30 is in the temporary stopping position, allow the insertion of the male terminal fittings 1 with its lances 6 protruding towards the exterior (see FIG. 4). Stopping members 38 protrude from upper and lower faces (on the right in FIG. 3) of these insertion holes 36. When the side retainer 30 is in the temporary stopping position, these stopping members 38 are in a position whereby they are moved away from the inner cavities 11B. When the side retainer 30 is in the main stopping position, these stopping members 38 are in a position whereby they protrude into the inner cavities 11B, thereby engaging an anterior end face of the main body 2 of each male terminal fitting 1 and doubly stopping the male terminal fittings 1 (see FIG. 9). A recessed groove 37 is formed between each of these stopping members 38, When the side retainer 30 is in the main stopping position the joining members 4 of the male terminal fittings 1 protrude into these recessed grooves 37. Moreover, a posterior end portion of each stopping member 38 is formed in a tapered shape to guide the male terminal fittings 1.

As shown in FIGS. 1 and 2, when the inner housing 20, with the side retainer 30 attached thereto, is to be attached within the fitting channel 12 of the outer housing 10, this attachment takes place from the opening side of the fitting channel 12, that is from the face side which fits with the corresponding female connector. A locking protrusion 13 is provided on an interior side face of the fitting channel 12. This locking protrusion 13 is provided on an interior side face of the fitting channel 12, and engages a locking member 26 provided on an outer side face of the inner housing 20, thereby maintaining the inner housing 20 within the fitting channel 12. At this juncture, the opening groove 22 of the inner housing 20 is covered by the wall constituting the fitting channel 12 (see FIG. 4).

Next, the assembly of the present embodiment, configured as described above, will be explained.

First the side retainer 30 is fitted from a horizontal direction into the opening groove 22 which opens into the side face of the inner housing 20. Then, the side retainer 30 is pushed inward, in the direction of the arrow in FIG. 2. Thereupon, the stopping protrusion 25 of the inner housing 20 fits into the temporary stopping groove 33 on the innermost side, relative to the direction of insertion, of the horizontal plate member 32 of the side retainer 30. As a result, a shown in FIG. 3, a posterior end portion, relative to the direction of insertion of the side retainer 30 is housed within the inner housing 20, the side retainer 30 being attached in the temporary stopping position.

Figure 5:
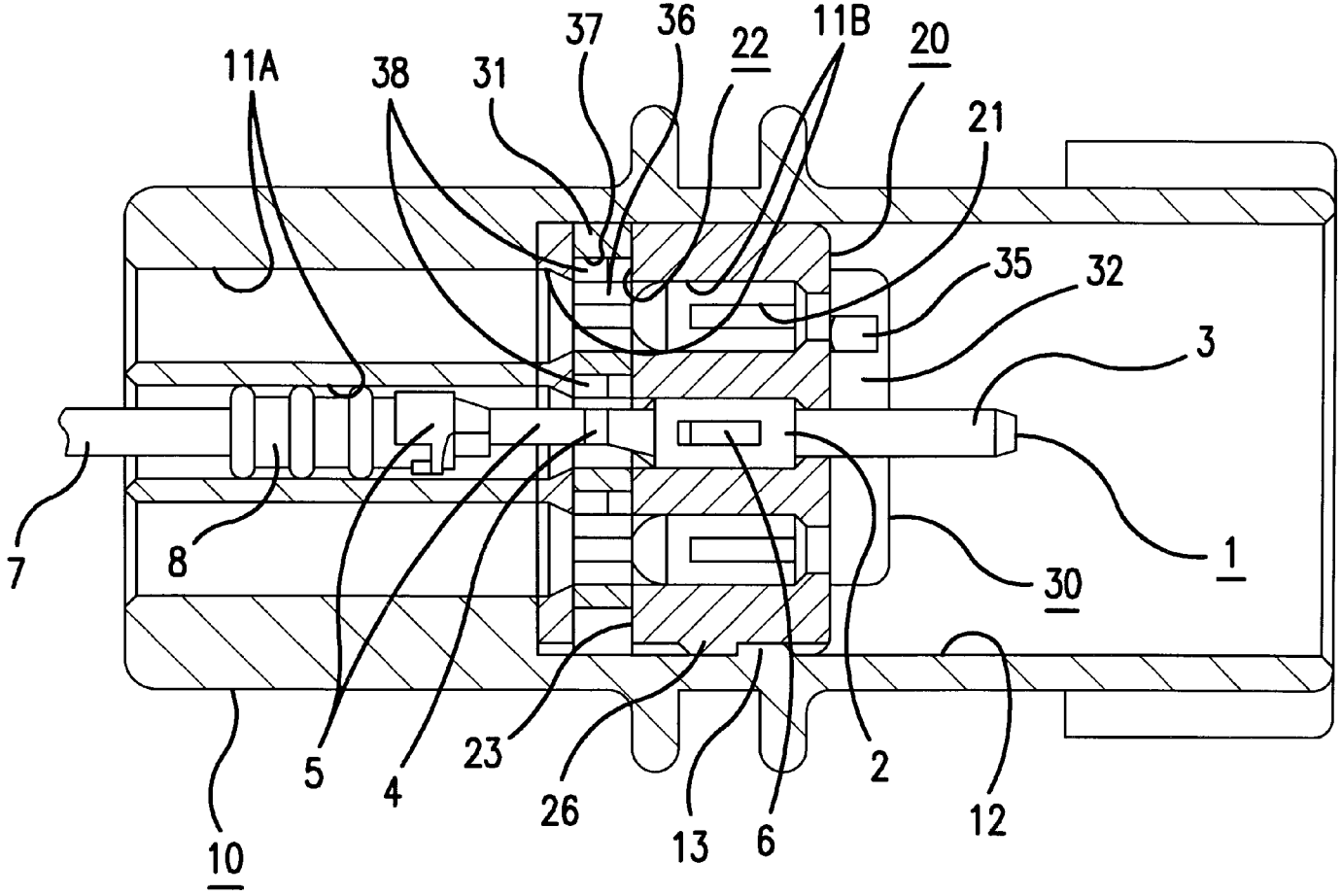
FIG. 5 is a plan view corresponding to FIG. 4.
Figure 6:
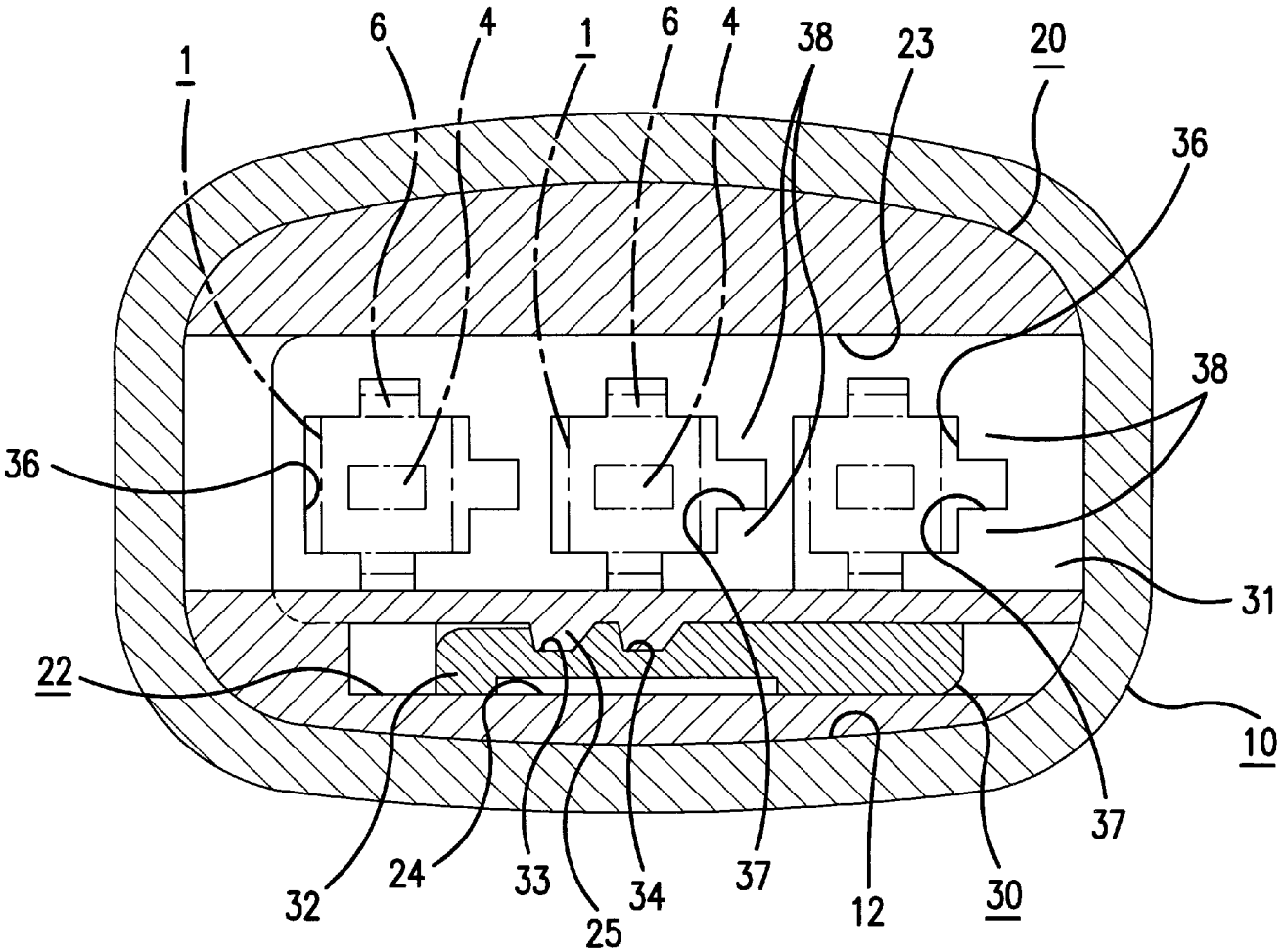
FIG. 6 is a cross-sectional view along the line X—X of FIG. 4.

Next, the inner housing 20, with the side retainer 30 attached thereto, is inserted from the anterior into the fitting channel 12 of the outer housing 10. Then, the locking member 26 of the inner housing 20 rises over the locking protrusion 13 provided in the fitting channel 12 and is engaged, the inner housing 20 thereby being attached within the outer housing 10, as shown in FIGS. 4 to 6. At this juncture, the stopping members 38 of the side retainer 30 are in a position whereby they are moved away towards the sides of the cavity 11. Next, the male terminal fittings 1, each being crimped to the electric wire 7 which has the waterproof rubber stopper 8 attached thereto, are inserted from the posterior of the outer housing 10 into the outer cavities 11A. As this occurs the lances 6 bend inwards and then engage with the stopping grooves 21 of the inner housing 20, thereby retaining the male terminal fittings 1.

Figure 7:
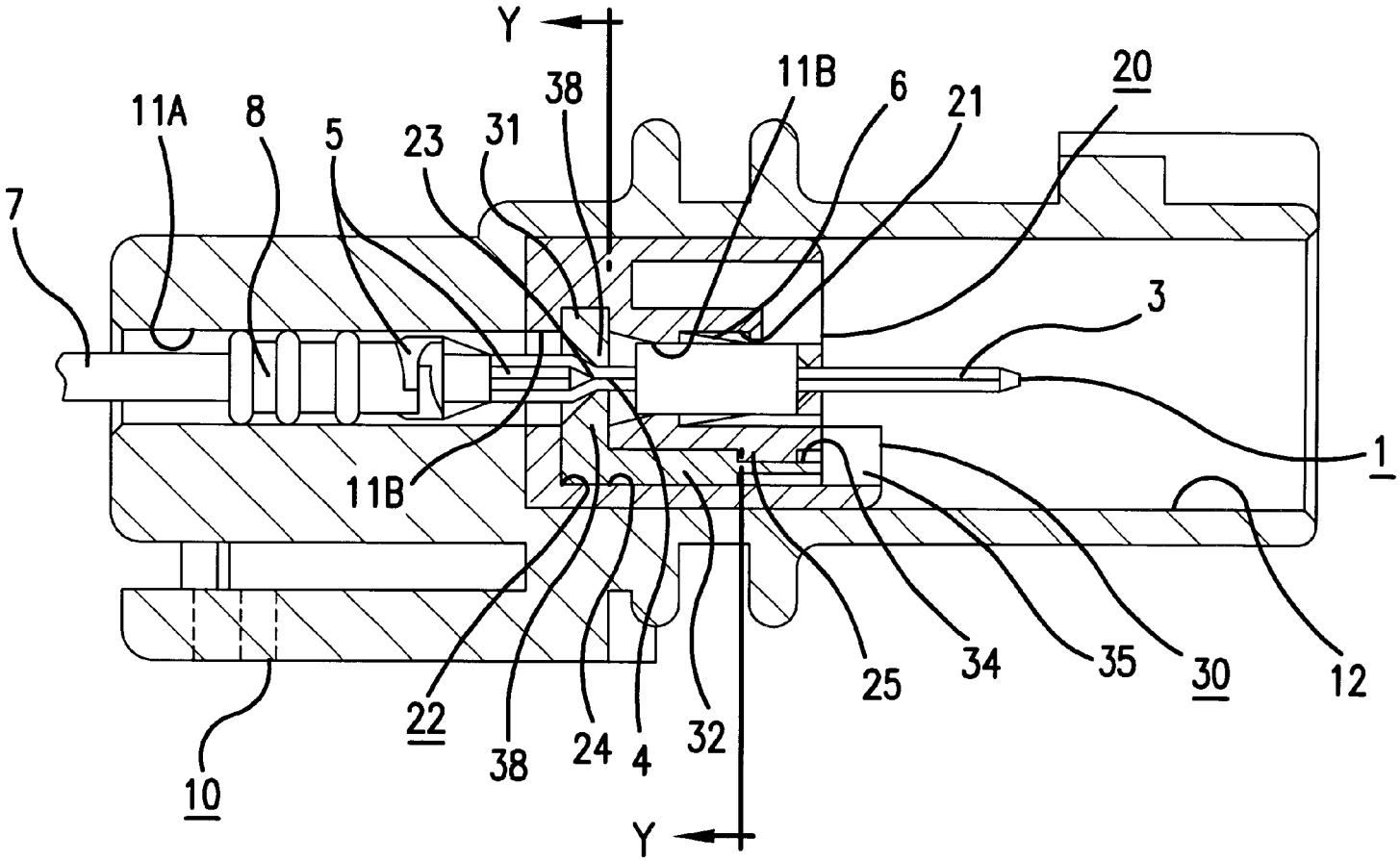
FIG. 7 is a side cross-sectional view of the connector provided with the side retainer in a main stopping position.
Figure 8:
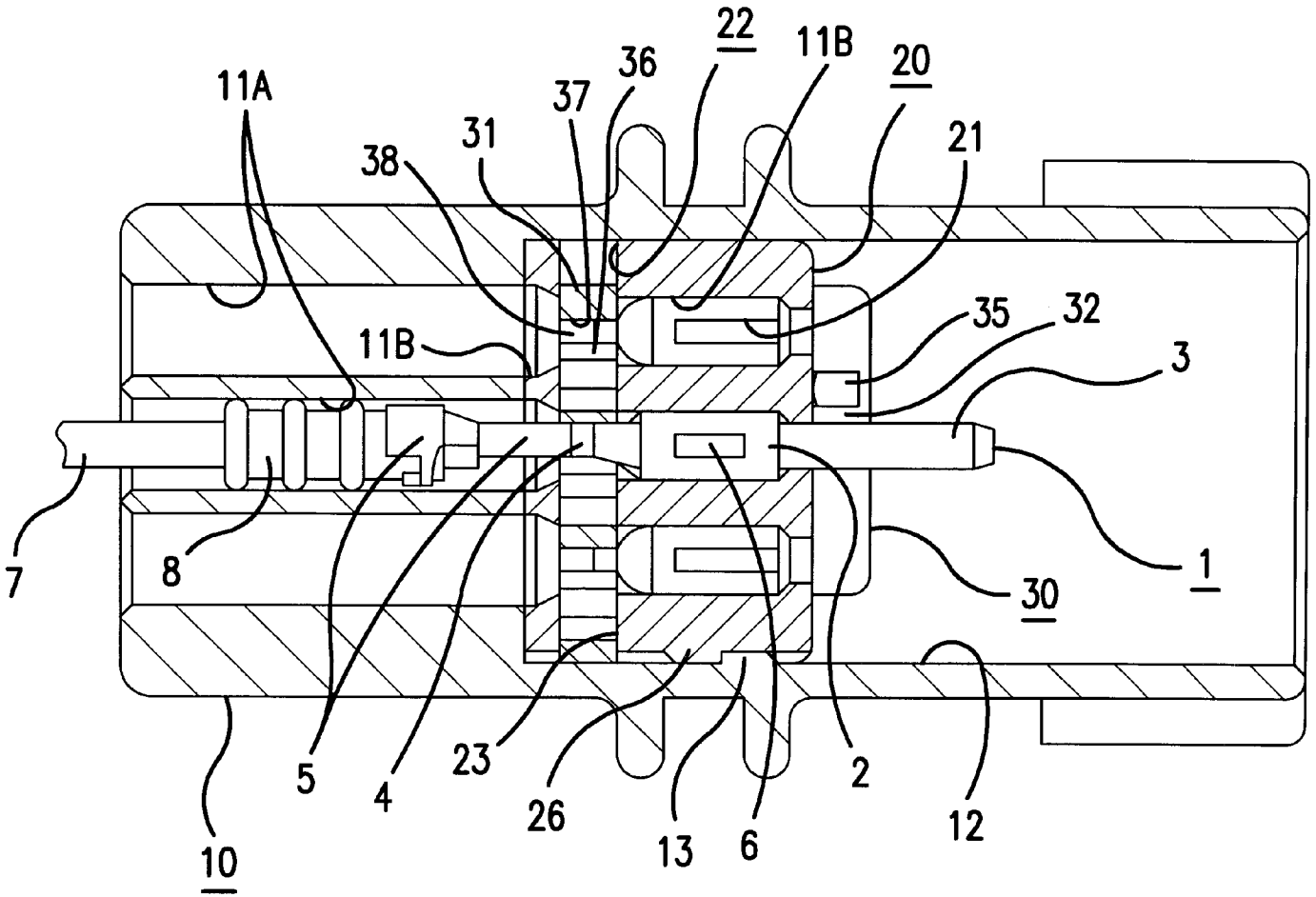
FIG. 8 is a plan view corresponding to FIG. 7.
Figure 9:
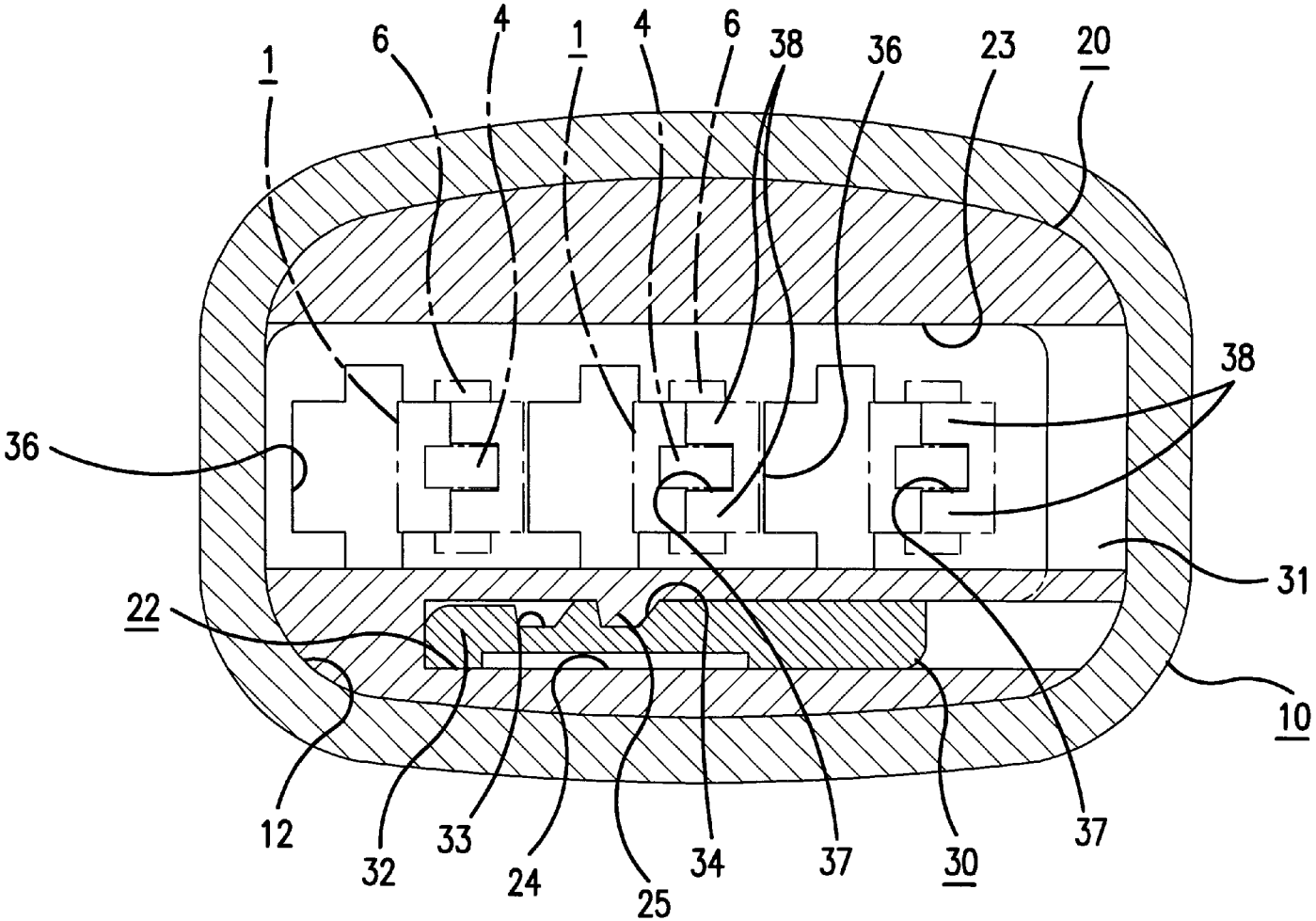
FIG. 9 is a cross-sectional view along the line Y—Y of FIG. 7.

After the male terminal fittings 1 have been attached within the cavity 11, a jig or the like is inserted into the fitting channel 12 to press the operating member 35 of the side retainer 30 towards the innermost side, relative to the direction of insertion and along the horizontal direction. As a result, the stopping protrusion 25 is disengaged from a wall of the temporary stopping groove 33, the side retainer 30 moves inwards and, as shown in FIGS. 7 to 9, the stopping protrusion 25 fits into the main stopping groove 34, thereby maintaining the side retainer 30 in the main stopping position within the inner housing 20. At this juncture, the vertical plate member 31 is moved in a direction intersecting with the direction of insertion of the male terminal fittings 1, the joining members 4 of the male terminal fittings 1 are gripped by the recessed grooves 37, and the posterior end face of each main body 2 is engaged by the stopping members 38, thereby doubly stopping the male terminal fittings 1 and reliably prevented their removal. After the male connector is attached in this manner, the fitting groove 12 is fitted to the corresponding female connector.

Furthermore, if the male terminal fittings 1 are to be removed for maintenance or the like, the corresponding female connector is removed, then a jig or the like is inserted into the fitting channel 12 to push the operating member 35 of the side retainer 30 towards its innermost direction and the side retainer 30 is moved from the main stopping position to the temporary stopping position. At this juncture, the recessed grooves 37 and the stopping members 38 of the vertical plate member 31 are in a moved away state from the cavity 11, and the engaged state of the main bodies 2 of the male terminal fittings 1 is released. Net the jig or the like is inserted into the stopping grooves 21 opening onto the anterior of the inner housing 20 the lances 6 of the male terminal fittings 1 are bent towards the interior, their engaged state is released, and the male terminal fittings 1 can be pulled out to the posterior.

According to the present embodiment as described above, the opening groove 11 provided on the inner housing 20 to allow the attachment of the side retainer 30 is covered by the outer housing 10. As a result, the opening portion of the inner housing 20 does not need to be provided with separate water-proofing components, and the configuration of the housing is therefore simplified. Furthermore, the inner housing 20 is attached from the opening side the fitting channel 12 of the outer housing 10, that is, from the fitting face side of the corresponding female connector. Consequently, compared to the case whereby the inner housing 20 is attached from an opening side of the cavity 11, the opening side of the cavity 11 can be smaller and the housing can be miniaturised. Moreover, the water-proof rubber stopper 8 to water-proof the opening of the cavity 11 can also be smaller.

The present invention is not limited to the embodiments described above with the aid of figures. For example, the embodiments described below also lie within the technical range of the present invention. In addition, the present invention may be embodied in various other ways without deviating from the scope thereof.

(1) The present invention is also suitable for a female connector.

(2) The present invention is not limited to the type of water-proof connector described in the above embodiment. It is also suitable for a connector using a non-water-proof side retainer. In that case, it would be possible to prevent foreign objects from entering the space between the side retainer and the housing and preventing the operation of the side retainer, etc.

What is claimed is:

1. An electrical connector comprising an outer housing, an inner housing insertable in the outer housing, said inner housing being adapted to receive an electrical terminal therein, and a retainer insertable in the inner housing, said retainer including a retaining portion and being movable between a temporary condition in which said terminal is insertable into the inner housing, and a final condition in which the retaining portion is engageable with the terminal to prevent removal of the terminal from the inner housing, the retainer and inner housing having a cooperating latch mechanism for holding the retainer in each of the temporary and final conditions, and the retainer being movable between said temporary and final conditions after insertion of said inner housing in said outer housing.

2. A connector according to claim 1 and having an attachment face for receiving a mating connector, said inner housing being inserted from said attachment face.

3. A connector according to claim 1 wherein said outer housing includes a tubular channel having a continuous peripheral wall, said inner housing being insertable within, said channel.

4. A connector according to claim 2 wherein said outer housing includes a tubular channel having a continuous peripheral wall, said inner housing being insertable within said channel.

5. A connector according to claim 3 and further including locking means to retain said inner housing within said outer housing.

6. A connector according to claim 4 and further including locking means to retain said inner housing within said outer housing.

7. A connector according to claim 5 wherein said locking means comprises resilient projections of said outer and inner housings.

8. A connector according to claim 6 wherein said locking means comprises resilient projections of said outer and inner housings.

9. A connector according to claim 1 wherein said retainer has two substantially perpendicular plates having a generally L-shaped configuration, and wherein a first plate has a portion of the cooperating latch mechanism to retain said retainer in said temporary and final conditions.

10. A connector according to claim 9 wherein the other of said plates includes an stopping member for engaging said terminal in the final condition.

11. A connector according to claim 9 wherein said retainer includes a operating member adapted to be engaged by a tool for movement of the retainer between the temporary and final conditions.

12. A connector according to claim 10 wherein said retainer includes a operating member adapted to be engaged by a tool for movement of the retainer between the temporary and final conditions.

13. A connector according to claim 11 wherein said terminal is housed partly in a chamber of the outer housing, and partly in a chamber of the inner housing.

14. A connector according to claim 12 wherein said terminal is housed partly in a chamber of the outer housing, and partly in a chamber of the inner housing.

15. A connector according to claim 1 and having a plurality of aligned terminals.

16. An electrical connector comprising an outer housing having a tubular portion, an inner housing having a chamber into which an electrical terminal is received and a cavity open in a side of the inner housing and in communication with the chamber, and a retainer insertable into the cavity in the inner housing, the inner housing and the retainer being inserted as a result as a unit into the tubular portion of the outer housing so as to be wholly contained therein, the retainer being movable in the cavity between a temporary condition in which the terminal is insertable in the chamber in the inner housing and a final condition in which the retainer engages the terminal to prevent removal of the terminal from the inner housing, the retainer and the inner housing having a cooperating latch for holding the retainer in each of the temporary and final conditions, and the retainer being movable between the temporary and final conditions after insertion of the inner housing in the outer housing.

17. An electrical connector in accordance with claim 16 in which the cavity and the retainer each generally have a complementary L-shaped configuration, and the retainer includes a first plate member adapted to engage the terminal in the final condition and a second plate member that includes a portion of the latch.

18. An electrical connector in accordance with claim 17 in which the first plate member is generally perpendicular to the terminal and includes an aperture through which the terminal is received.

19. An electrical connector in accordance with claim 16 in which the outer housing includes an opening for receiving a complementary connector, and the retainer further includes an operating member protruding from the retainer toward the opening, the operating member being engageable for moving the retainer between the temporary and final conditions.

20. An electrical connector in accordance with claim 16 in which the outer housing further includes a chamber aligned with the chamber in the inner housing such that the terminal is contained partly in the chamber of the inner housing and partly in the chamber of the outer housing.

* * * * *